United States Patent [19]

Cameron

[11] 4,226,375

[45] Oct. 7, 1980

[54] REDUCTION MILL

[75] Inventor: Wallace C. Cameron, San Pedro, Calif.

[73] Assignee: Copper Alloys Corp., Beverly Hills, Calif.

[21] Appl. No.: 972,028

[22] Filed: Dec. 21, 1978

[51] Int. Cl.[3] ..... B02C 13/284

[52] U.S. Cl. ..... 241/88.4; 241/89.2; 241/89.3; 241/189 R; 241/285 B

[58] Field of Search ..... 241/73, 89.2, 89.3, 241/88.4, 190, 189 R, 285 A, 285 B, 285 R

[56] References Cited

U.S. PATENT DOCUMENTS

| | | | |
|---|---|---|---|
| 1,470,177 | 10/1923 | McNaughton | 241/89.2 X |
| 1,625,554 | 4/1927 | Liggett | 241/73 |
| 1,936,025 | 11/1933 | Mahaffey | 241/73 |
| 3,813,045 | 5/1974 | Greiffenstern | 241/88.4 |
| 4,015,783 | 4/1977 | Miller | 241/73 |
| 4,049,206 | 9/1977 | Konig et al. | 241/73 |
| 4,146,184 | 3/1979 | Whitney | 241/89.2 X |

*Primary Examiner*—Mark Rosenbaum
*Attorney, Agent, or Firm*—I. Morley Drucker

[57] ABSTRACT

A more efficient reduction mill is described having a rotating hammer mill portion combined with a grate assembly system employing readily reversible and replaceable grate sections, including reversible and replaceable cutter bar sections forming part of the grate system. The entire grate system is mounted in a side position of discharge with respect to the axis of rotation of the hammer mill and is pivotally disengaged about a lower pivot axis by power means from the hammer mill portion. Ready access to the grate assembly for reversal or replacement of worn sections is thereby achieved. The ease of accessability to the grate assembly, combined with the ease of reversibility and/or replaceability of the various grate sections enables close spacing between the grate assembly and hammer mill to be more readily maintained thereby permitting more efficient reduction of a variety of materials, and more efficient later handling and separation of ferrous from non-ferrous materials.

12 Claims, 6 Drawing Figures

REDUCTION MILL

FIELD OF THE INVENTION

The invention herein lies in the field of improvements in rotary hammer mills. The term "rotary hammer mill" as used herein, is meant to include reduction mills, mills operating on a rotary shear principle, shredders, fragmentizers, and pulverizers, all for the purpose of size reduction of a variety of materials including metals, ores and slags, and solid wastes from municipalities and the like.

BACKGROUND OF THE INVENTION

Many different types of rotary hammer mills are found in the art employing reversible or readily replaceable grate bars or sections. Typical of early structures are found in the patents issued to:

| PATENTEE | PATENT NO. |
|---|---|
| Albrecht | 604,283 |
| Borton | 759,856 |
| Armstrong | 1,170,389 |
| Williams | 1,420,355 |

In Anderson, U.S. Pat. No. 1,746,512, an improved grate bar is described which has a rectangular cross-section with spaced lugs extending therefrom, which together with like grate bars, forms an overall grate having reversible features. Grate bar assemblies having various improvements in terms of ease of reversibility, increased structural strength, and more ready accessability are also shown in one or more of the following patents.

| PATENTEE | PATENT NO. |
|---|---|
| Williams | 3,465,973 |
| Greiffenstern | 3,813,045 |
| Miller | 4,015,783 |
| Whitney | 4,061,277 |

In spite of the great amount of prior art in this field, there remains a real need for (1) a more readily available access means to both the grate assembly structure and hammers so that the various components of both grate and hammers can be readily replaced or reversed as the need arises, and (2) for a grate assembly structure which coacts with the hammers of the hammer mill to achieve more efficient size reduction of material.

It will be understood that because of the tremendous impact forces acting upon the grate assembly by virtue of the high speed rotation of the hammers as they reduce, by shear, crushing, etc. metallic materials such as auto bodies, small motors, ores, slags, solid wastes, and the like, there is a great need for an extremely efficient means for obtaining rapid access and entry to both the grate system and the hammers of the hammer mill to replace worn parts, or to reverse certain grate components to present fresh shearing surfaces—all for the purpose of maintaining, as closely as possible, the optimum dimensional relationship between hammers and grate assembly, with minimum down-time, for a wide variety of materials ranging from municipal wastes to fractional horsepower motors. Related to the overall aim of this invention is the use of a more efficient grate system, than has been heretofore contemplated, permitting more efficient size reduction of such a great variety of materials.

It is a major object of this invention to remedy the above-described deficiencies of the prior art.

SUMMARY OF THE INVENTION

The grate assembly system of this invention incorporates therewith a series of spaced cutter bars, these cutter bars coacting with rotating hammers of the hammer mill section to effect size reduction by shear, as well as by crushing or pulverizing of the material entering the mill charging area. The entire grate system is concentrated within an approximately 140°-170° arc mounted in the side of the reduction mill, i.e., over an arc extending from approximately 6:30-11:30 o'clock. The entire grate system is mounted within a grate housing that is pivotally mounted about a pivot axis that is near or at the lowermost edge of the grate housing so as to be readily disengaged from, and re-engagable with, the mill cage housing or zone. Providing a lower pivot axis permits the grate assembly to be tilted upwardly and exposed at an angle that makes the grate assembly cutter bars and screen bars easily accessible for removal or reversal. Pivotal disengagement and re-engagement of the grate housing is optimally made under power means, such as hydraulic rams or pistons.

There are major advantages of this mode of assembly of grate components. First, the concentration of all grate components over a 6:30 to 11:30 o'clock arc of 140°-170° in combination with the entire pivotal disengagement thereof enables every component of the grate system to be readily accessible for reversibility or replacement. It also permits the hammers (with or without replaceable tips or caps) to be simultaneously readily accessible for inspection and/or replacement.

Ready accessibility to the grate assembly and hammer mill portions enables predetermined tolerances between these elements of the rotary hammer mill to be more readily attained. The side discharge permits the entire bottom of the mill to be a solid anvil wall and to be placed upon on-grade foundations rather than requiring foundations to be dug below-grade in pits or the like—as is the case in bottom discharge mills.

The arcuate grate system itself incorporates a series of screen bars (i.e., bars of complex shape having openings therein) alternating with solid cutter bars of simple rectangular cross-sectional to make up the grate means. The cutter bars and screen bars are both completely reversible, end for end, and top for bottom (and readily replaceable when necessary upon pivotal disengagement of the grate housing from the mill cage zone). The use of cutter bars, forming a *part* of the grate system, in the 6:30 to 11:30 o'clock position, rather than as an initial forerunner, to the grate assembly, offers a more efficient shearing action to be interposed since material reduced to proper size by a cutter bar will be discharged through an immediately adjacent opening in the grate structure—rather than be carried to other cutter bars for further unnecessary size reduction—with consequent further unnecessary wear on the cutter bars.

Furthermore, it is much more economical to replace a cutter bar, of simple rectangular cross-section than a more complexly shaped screen bar—and the structure of the design herein favors the replacement of the simple-shaped cutter bar sections.

DETAILED DESCRIPTION OF THE INVENTION

Figure 1:
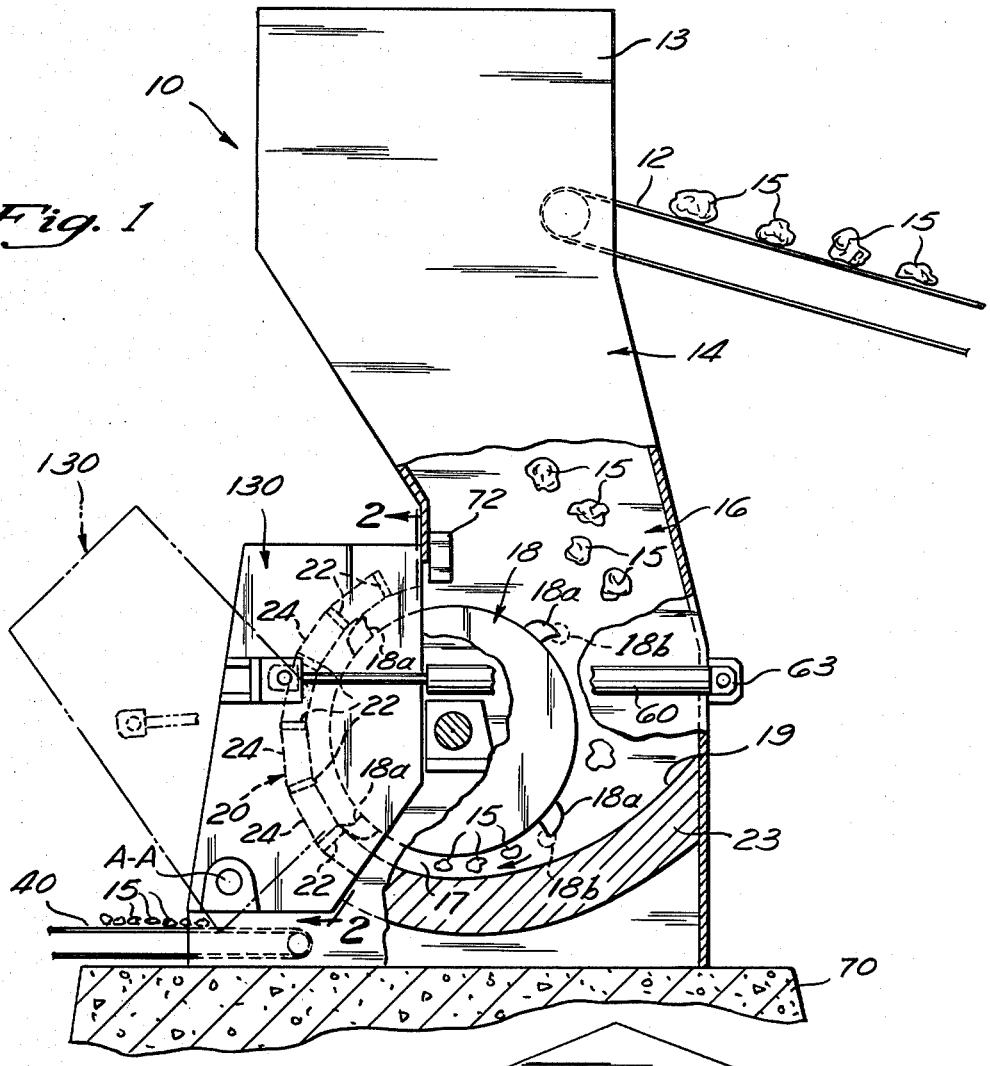
FIG. 1 is a schematic drawing of the reduction mill, in side elevation, showing the rotary hammer mill and grate system of this invention, in partial cross-section.

A reduction mill 10 is shown, in schematic form, in FIG. 1, incorporating a rotary hammer mill 18 and grate means or grate assembly structure 20 of this invention. The reduction mill 10 is provided with an inlet conveyor 12 of conventional type, bringing any of a number of types of material 15, to be reduced in size, into the feed bonnet 13 at the top of the mill 10. The material 15 to be processed may be metallic (ferrous or non-ferrous), glass, ore, slag, small motors, or municipal wastes, set forth herein, by way of example only. The material to be processed then drops into and through a charging area 14 and into the actual size reduction zone or mill cage zone 16.

The material 15 moves from the cage mill zone 16 under the influence of the high-speed rotation of hammers 18*a* of hammer mill 18 into the ever-decreasing channel area 17, defined by the anvil wall 19 and the hammer mill 18. The hammer mill 18 and the anvil wall 19 are formed from specially hardened, but conventional, metallic materials.

It is a major object of this invention to provide the means required to maintain a close tolerance between the hammers 18*a* and the grate assembly means 20. More particularly, the grate means 20 is placed within a grate housing 30 so that all elements forming the grate assembly means are concentrated within an arc extending over, preferably, about 140°–170°. The grate means is further located at from about the 6:30 to 11:30 o'clock position with reference to a vertical plan passing through the axis of rotation of the hammer mill 18. Material 15, after being comminuted to the appropriate size for passage through the openings of the grate means 20, will then pass through the open bottom of the grate housing 130 (not shown) and onto the outlet conveyor means 40 (of conventional type) moving, in endless fashion, from the lower side, or corner of the hammer mill 10.

Figure 5:
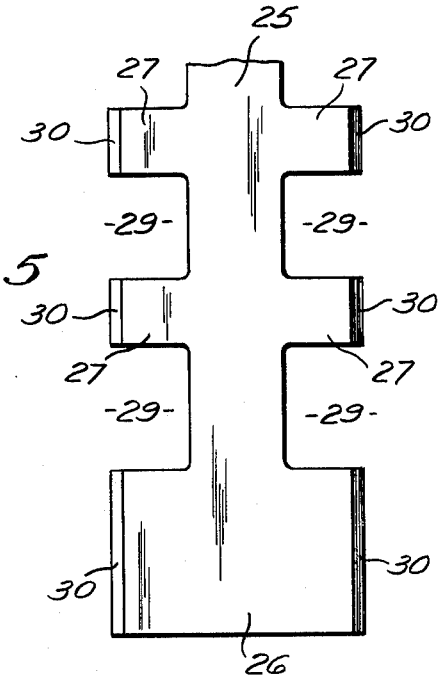
Figure 6:
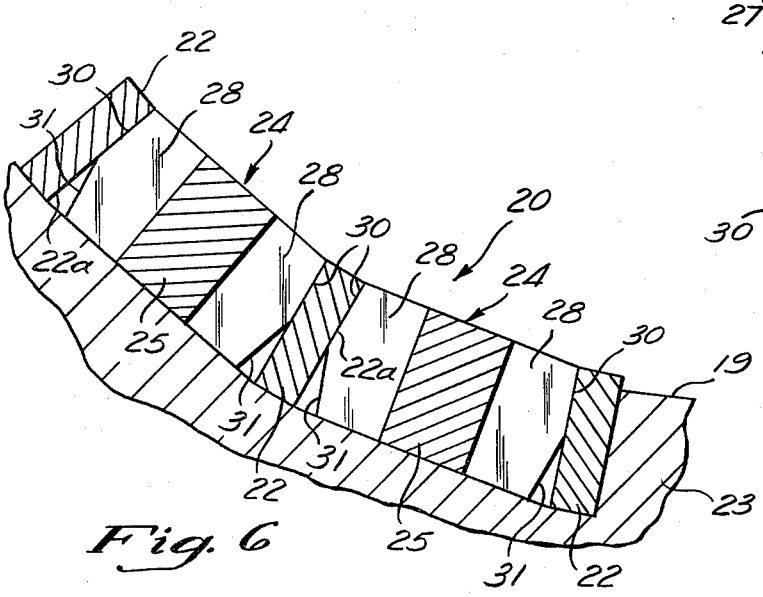
FIG. 6 is a partial cross-sectional view of the grate structure of this invention, taken along the line 6—6 of FIG. 2.

The grate means 20 comprises a series of screen bars 24 alternating with cutter bars 22, as best seen in FIGS. 3–6. The screen bars 24 each have a generally rectangular in cross-section spine, or central member 25, terminating in enlarged foot portions 26. Integrally formed with the spine 25 are spaced projection members or lug members 27, the spaced 29 between adjacent lug members forming the openings 28 of the grate means when the cutter bars 22 are placed in alternating fashion with screen bars 24 as best shown in FIG. 6.

Figure 3:
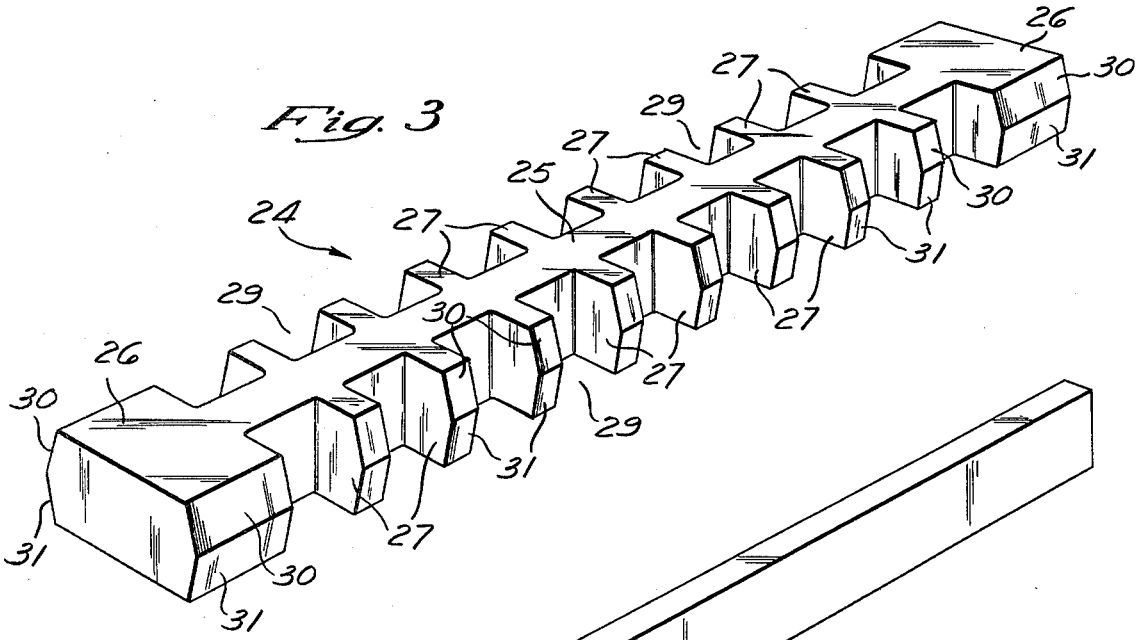
FIGS. 3 and 5 are perspective and fragmentary top plan views, respectively, of a screen bar of the grate structure of this invention.
Figure 4:
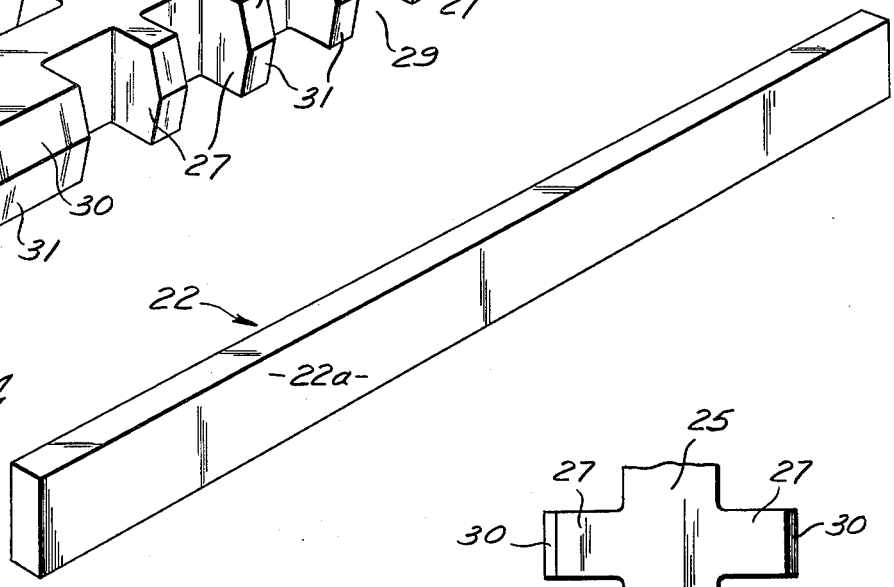
FIG. 4 is a perspective view of cutter bar incorporated into the grate structure of this invention.

As viewed in FIGS. 3, 5 and 6, each of the lug members 27 and foot portions 26 has a pair of upper and lower beveled end faces 30, 31 symmetrically formed about the major (i.e., central) horizontal axis of the screen bar 24. End faces 30, 31 have an obtuse angular relationship to each other. When the screen bars 24 are placed in abutment with the cutter bars 22 to form the arcuate grate assembly 20, the upper end faces 30 abut the side surfaces 22*a* of the cutter bars 22. The abutment of end faces 30 of the screen bars 24 with the side surfaces 22*a* of the cutter bars 22 serve to wedge the elements constituting the entire grate assembly 20 into a unitary mass to more readily resist the high impact and shear forces which it encounters.

The entire grate assembly 20 is stably held in place at the ends thereof by arcuate metallic liners 50 bolted to the grate housing 130, the arcuate liners retaining foot portions 26 and the ends of each of the cutter bars 22.

It will be realized that as material 15 is processed, in the reduction mill 10, the hammers 18*a* of the rotary hammer mill 18 (with or without replaceable tips or caps for hammers 18*a*) will coact with cutter bars 22 of grate assembly to exert major forces in shear resulting in ready and efficient comminution of material. Such material 15 exits the grate assembly 20, through openings 28 thereof, and is discharged from the mill 10 via conveyor 40, as earlier set forth.

Major wear will take place on the cutter bars 22 relative to the screen bars 24, and these will be reversed and/or replaced more often than the screen bars. However, the design of the cutter bar 22 is that of a simple rectangular bar which shape is much more readily and economically fabricated than the more complicated screen bar 24. The combination of a series of rectangular cutter bars 22 alternating with screen bars 24 of more complex shape, as described, to form the arcuate grate means 20 is a more efficient means for size reduction of material of the types heretofore mentioned for the reasons herein just set forth.

A secondary cutter bar means 72 may be placed in or just above the mill cage zone 16 and this bar may be made adjustable in the vertical direction to effect a still further shearing and comminution of material re-entering the mill cage zone 16.

Figure 2:
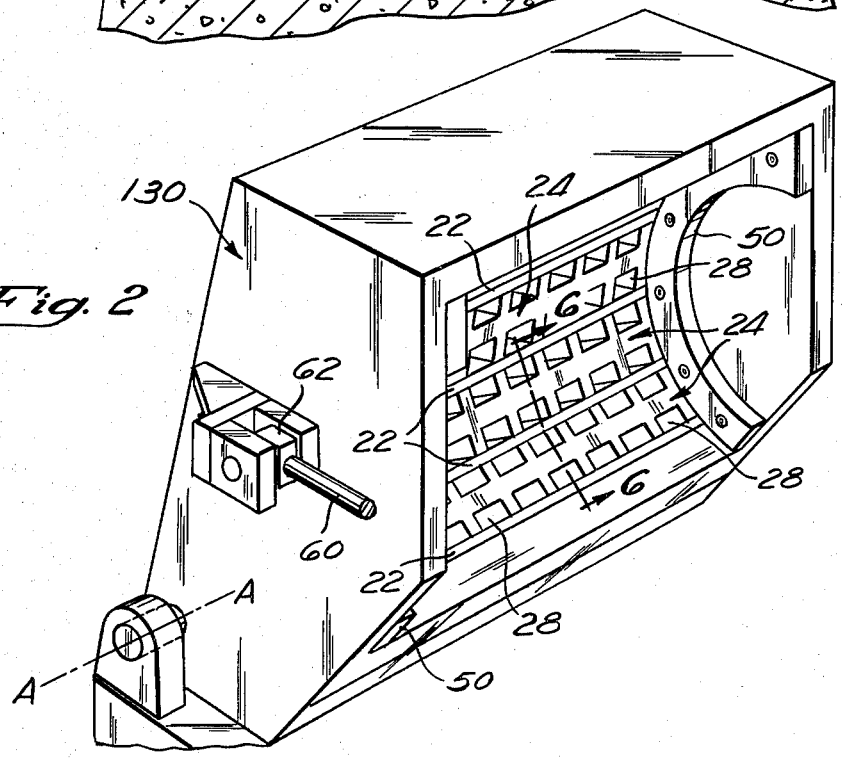
FIG. 2 is a perspective view of the grate housing and internal grate structure only taken along the line 2—2 of FIG. 1.

The access means to the grate assembly 20 will now be described. A hydraulic power piston or ram means 60 has one end linked to the outer ends of the grate housing 130 by a conventional pivot linkage means 62 and the other end 63 is operatively connected to a power means (not shown). See FIGS. 1 and 2). The grate housing 30 is itself mounted for pivotal movement about a pivot axis at or near its lowermost left-hand corner A—A, as best seen in FIGS. 1 and 2. The grate housing 130 is first unlocked from the mill cage area or zone 16, the locking means not being shown and being conventional. As hydraulically powered piston or ram 60 moves to the left in FIGS. 1 and 2, the grate housing 130 will pivot about pivot axis A—A to the position shown in dotted line in FIG. 1. In this position, the entire grate assembly 20 is exposed. The liners 50 holding the grate assembly 20 are then readily removed, after first unbolting them from the grate housing 130, thereby enabling the separate screen and cutter bar elements 24, 22 to be removed by conventional lifting means, for reversal end to end or top to bottom, or for outright replacement as the need arises.

The cutter bars 22 are made of an especially hardened material such as high tensile strength steel that is impact and abrasion resistant; the screen bars are made of similar materials.

It will also be noted that the pivotal disengagement of the grate assembly 20 from the mill cage area or zone also exposes the hammer mill elements for inspection and repair or replacement as needed.

The placement of the grate assembly 20 in an arcuate segment extending over a 140°–170° arc, and located at between about the 6:30 to 11:30 o'clock position (with reference to a vertical plane passing through the axis of rotation of the rotary hammer) enables side discharge of material, as shown. The reduction mill 10 can then be placed upon on-ground foundations 70 rather than having expensive foundations poured below-ground in pits dug to accommodate bottom discharge of material.

It is important that close tolerances be maintained between the grate assembly and especially the cutter bars 22 thereof and the hammers 18. It is important, for example, that a 2" average comminution size be achieved in order that optimum separation of ferrous material such as nuts, bolts, screws and the like be made from non-ferrous materials. It is also important from a recycling point of view, to handle comminuted scrap of small size; such scrap is more easily remelted, refined, etc.

To further aid in maintaining such close tolerances, replaceable tips **18*b* (see FIG. 1) for hammers 18*a*** are preferably employed, one type of which is shown and described in commonly owned co-pending application Ser. No. 924,500 filed on July 14, 1978 and incorporated herein by this reference. Replaceable caps for hammer mills may also be employed, e.g., of the type shown and described in U.S. Pat. No. 3,727,848, issued Apr. 17, 1973 and incorporated herein by reference.

A more efficient reduction mill has been described employing a rotating hammer mill combined with a grate assembly system havig readily reversible and replaceable grate sections, including reversible and replaceable cutter bar sections forming part of the grate system. The entire grate system is pivotally removable by power means, as a unit, from the hammer mill portion, to achieve ready access to the grate system for reversal or replacement of worn sections. The ease of accessability to the grate system, combined with the ease of reversibility and replaceability of the grate elements enables predetermined close spacing between grate sections and hammer mill to be more readily maintained thereby permitting more efficient reduction of material.

Close tolerances between grate assembly 20 and the hammer means 18 may be further maintained by causing the entire grate assembly 20 to be adjustably moved, along a horizontal axis, to the extent of several inches, e.g., by shims placed behind the grate assembly 20 (not shown).

Other modifications will occur to those skilled in the art falling within the scope of this invention. Hence, I intend to be bound only by the claims which follow.

I claim:

1. In a reduction mill for material comminuted having upper inlet means for said material, rotary hammer means mounted, in a mill cage zone, for rotation below said inlet means, a grate housing, and side outlet means to receive and discharge said comminuted material, the improvement which comprises:

a grate assembly, removably mounted within said grate housing, having openings mounted in a side position of discharge with respect to a vertical plane passing through the axis of rotation of said rotary hammer means, said grate assembly comprising a plurality of screen bars having spaced projections formed along the length thereof, alternating with a plurality of cutter bars to form discharge openings alternating with cutting edges, said grate assembly coacting in a first position, with said rotary hammer means to cause said material to be comminuted and passed through said discharge openings in said grate assembly and through said side outlet means;

pivot means for pivotally disengaging both said grate housing, and said grate assembly removably mounted therewithin, from said first position of coaction with said mill cage zone about a common pivot axis located at the lowermost portion of said grate housing whereby exposure of said entire grate assembly for access and inspection is readily obtained; and power means for pivotally disengaging said grate housing together with said grate assembly from said first position of coaction to said second position of disengagement.

2. The reduction mill of claim 1 wherein said grate assembly extends over an arc of between about 140°–170°.

3. The reduction mill of claim 1 wherein said grate assembly extends over an arc ranging from about 6:30–11:30 o'clock with respect to the axis of rotation of said rotary hammer means.

4. The reduction mill of claim 1 wherein said screen bars and cutter bars are separate members and are symmetrical about their major axes whereby each of said screen bars and cutter bars are separately replaceable or reversible.

5. The reduction mill of claim 1 wherein said spaced projections of said screen bars have beveled end faces forming an obtuse angle with each other.

6. The reduction mill of claim 1 wherein said rotary hammer means is provided with hammers, each having a replaceable tip.

7. The reduction mill of claim 1 wherein a secondary adjustable cutter bar means is located immediately adjacent said mill cage zone for further shearing and comminution of material.

8. A reduction mill for material comminution which comprises:

upper inlet means for said material;

rotary hammer means mounted, in a cage mill zone, for rotation below said inlet means;

a grate housing;

a grate assembly removably mounted within said grate housing, said grate assembly extending over an arc of approximately 140°–170° and having discharge openings mounted in a side position of discharge with respect to a vertical plane passing through the axis of rotation of said rotary hammer means, said grate assembly comprising a plurality of screen bars having spaced projections formed along the length thereof, alternating with a plurality of cutter bars to form cutting edges alternating with said discharge openings, said plurality of cutter bars coacting, in a first position, with said rotary hammer means to cause said material to be comminuted and passed through said discharge openings in said grate assembly;

outlet means positioned below said discharge openings of said grate assembly to receive and discharge said comminuted material from said reduction mill; and powered pivot means for pivotally disengaging said grate housing, together with said grate assembly removably mounted therewithin, from said first position of coaction with said rotary hammer means to a second position of disengagement from said mill cage zone about a common pivot axis located at the lowermost portion of said grate housing whereby exposure of said entire grate assembly for access inspection and replacement or reversal of components of said grate assembly is readily obtained.

9. The reduction mill of claim 8 wherein said screen bars and cutter bars are separate members and are symmetrical about their major axes whereby said bars are separately replaceable or reversible.

10. The reduction mill of claim 8 wherein said spaced projections of said screen bars have beveled end faces forming an obtuse angle with each other.

11. The reduction mill of claim 8 wherein said rotary hammer means is provided with hammers, each having a replaceable tip.

12. The reduction mill of claim 8 wherein a secondary adjustable cutter bar means is located immediately adjacent said mill cage zone for further shearing and comminution of material.

* * * * *